United States Patent [19]

Kyle

[11] 4,162,599

[45] Jul. 31, 1979

[54] VACUUM PACKAGING

[75] Inventor: Rhoden R. Kyle, Toronto, Canada

[73] Assignee: C. A. Pemberton & Co. Limited, Toronto, Canada

[21] Appl. No.: 916,721

[22] Filed: Jun. 19, 1978

[51] Int. Cl.[2] ..... B65B 31/02; B65B 31/04

[52] U.S. Cl. ..... 53/77; 53/86; 53/511

[58] Field of Search ..... 53/77, 86, 510, 511

[56] References Cited

U.S. PATENT DOCUMENTS

| | | | |
|---|---|---|---|
| 3,164,934 | 1/1965 | Pancratz | 53/511 |
| 3,902,302 | 9/1975 | Tartarini | 53/511 |

*Primary Examiner*—Travis S. McGehee

*Attorney, Agent, or Firm*—Fetherstonhaugh & Co.

[57] ABSTRACT

In a vacuum packaging machine there is provided the combination of a sealing unit and vacuum unit. The sealing unit comprises first and second sealing dies and the vacuum unit comprises a primary spacer located adjacent the input end of the sealing dies. The primary spacer is spaced from the first die to form a first web feeding passage therebetween and is spaced from the second die to form a second web feeding passage therebetween. The vacuum unit also includes a secondary spacer located adjacent the input end of the dies and mounted for movement between a retracted position permitting closure of the dies to effect sealing and an extended position maintaining at least a portion of the webs which passed through the first and second web feeding passages, in a spaced relationship to permit evacuation of the container space formed between the webs. A drive mechanism is provided for driving the secondary spacer to and fro between the retracted and extended positions and vacuum passages are provided in the vacuum drawing unit opening towards the sealing dies for communicating with the interior of a packaging space when the secondary spacers are in the extended position to maintain the webs in a spaced relationship whereby atmosphere from the container space may be withdrawn through the vacuum passage means prior to sealing of the webs.

8 Claims, 4 Drawing Figures

VACUUM PACKAGING

FIELD OF INVENTION

Figure 1:
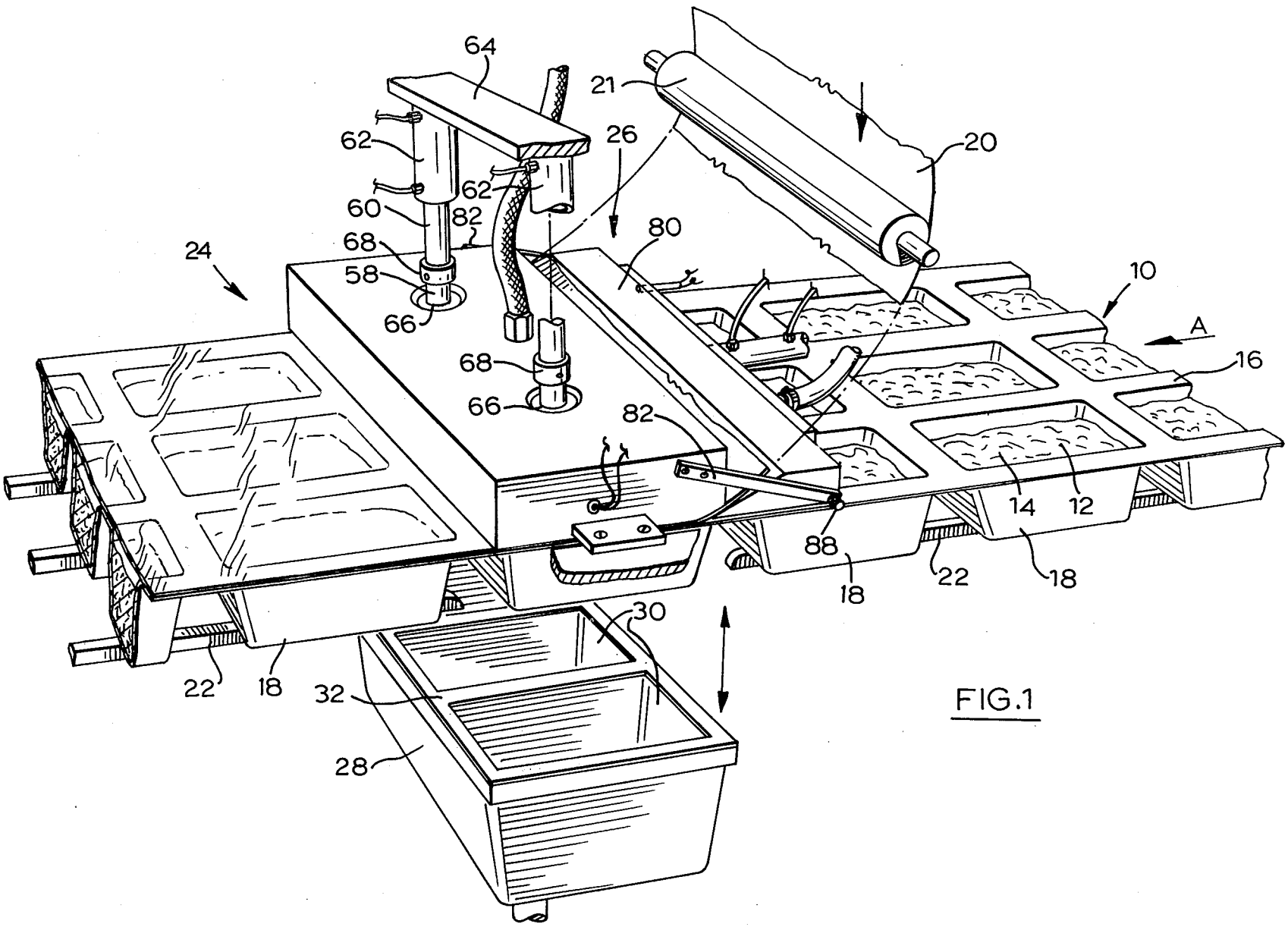

This invention relates to vacuum packaging machines. In particular, this invention relates to improvements in a vacuum packaging machine which serve to permit a direct evacuation of the container space.

PRIOR ART

Considerable difficulty has been experienced in attempting to vacuum-pack food products because the reduction in pressure in the container space can adversely affect the character of the product during the packaging operation. If, for example, a cheese product is to be vacuum packaged in a container, the reduction in pressure in the space around the cheese product, during the packaging operation, may be such that the cheese product may explode. This is particularly true in cheese products where there are voids in the body of the cheese which are filled with air or other gases. The gases which are trapped within the cheese are at a higher pressure than the vacuum pressure within the container space with the result that the trapped gases can cause the body of cheese to explode. Similarly, the reduction in pressure in the vacuum packaging of meats can cause the juices within the meat to be forced to the surface of the meat so that the meat has an oily appearance and texture.

In the widely used vacuum packaging processes in which a pocket is formed in one web of material and a second web is placed over the open end of the pocket, it is customary to locate both webs between a pair of sealing dies during the sealing operation and to locate a vacuum chamber about the outer face of each web and to draw a vacuum in this chamber to prevent inward collapsing of the webs when a vacuum is drawn in the container space between the webs.

I have found that many of the difficulties associated with the damage to products such as cheese and meat can be overcome by permitting the webs to collapse inwardly to physically support the product when a vacuum is drawn in the container space formed between the webs. The inward collapsing of the webs serves to physically support the product thus preventing explosions and preventing the migration of juices to the surface of the product. This can, however, only be achieved by providing for the physical spacing apart of the webs to provide a vacuum passage communicating with the container space between the webs during the vacuum packaging operation.

SUMMARY OF INVENTION

It is an object of the present invention to provide a spacer mechanism for positively spacing the webs from one another to provide access to the container space formed therebetween during the time that a vacuum is drawn in the vacuum space.

According to one aspect of the present invention, there is provided in combination a sealing unit and a vacuum unit for use in a vacuum packaging machine in which a container space formed between oppositely disposed sealing faces of a pair of sealable webs is to be evacuated before the webs are sealed together about the periphery of the container space. The sealing unit comprises first and second sealing dies mounted one on either side of a sealing plane for movement relative to one another between an open position to permit movement of a package forming web assembly therebetween and a closed position for engaging and sealing said web assembly. The sealing unit has an input end for receiving web to be sealed between said dies and an output end through which sealed packages are discharged. The vacuum unit comprises primary spacer means located adjacent said input end of said sealing dies, said primary spacer means being spaced from said first die to form a first web feeding passage therebetween and spaced from said second die to form a second web feeding passage therebetween whereby said primary spacer means is located between oppositely disposed sealing faces of webs being fed into said dies through said first and second web feeding passages, secondary spacer means located adjacent said input end of said dies and mounted for movement between a retracted position permitting closure of the dies to effect sealing and an extended position maintaining at least a portion of the webs in a spaced relationship to permit evacuation of the container space formed therebetween, means for driving said secondary spacer means to and fro between said retracted and extended positions, vacuum passage means in said vacuum drawing unit opening towards said sealing dies for communicating with the interior of a packaging space when said secondary spacer means is in said extended position to maintain said webs in a spaced relationship whereby atmosphere from the container space may be withdrawn through said vacuum passage means prior to sealing of the webs.

According to a further aspect of the present invention there is provided a combination described in the preceding paragraph wherein the first sealing die has a chamber formed therein to accommodate the protrusion formed in the first web to form the container space, the chamber being isolated from the vacuum passage means by the first web in use such that the first web is free to collapse inwardly about the product located within the container space as the vacuum is drawn within the container space thereby to physically support the article.

PREFERRED EMBODIMENT

Figure 2:
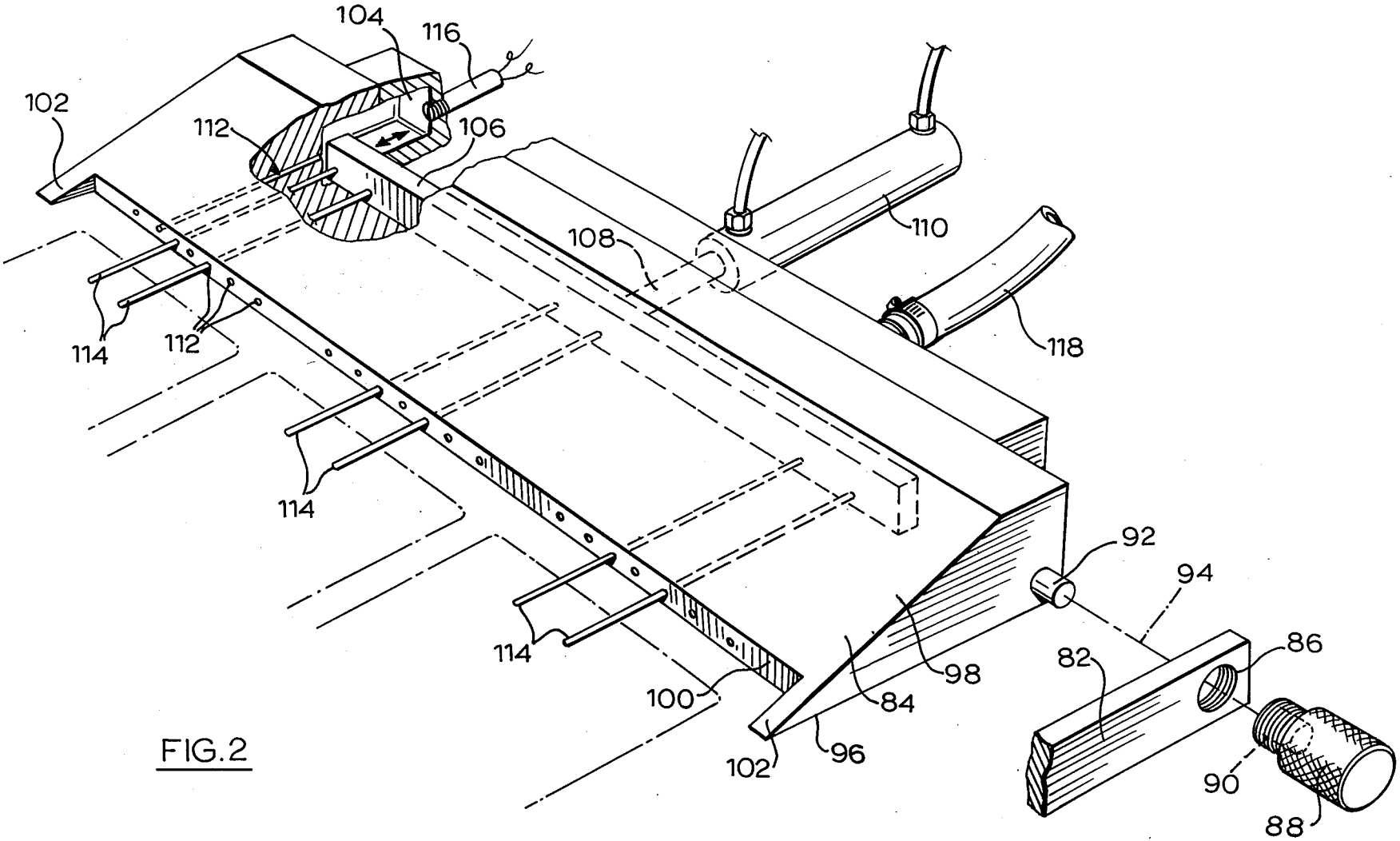
Figure 3:
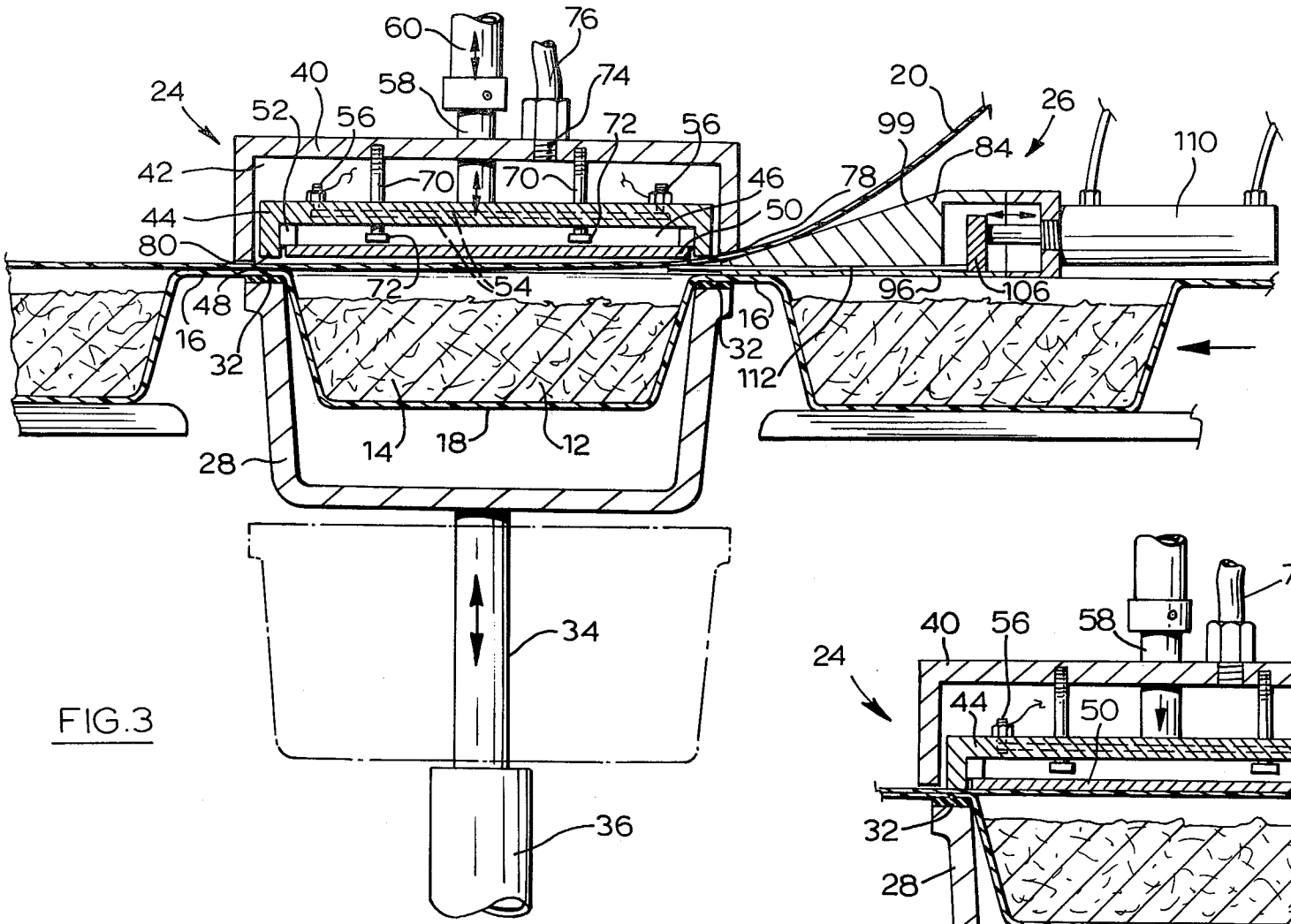
Figure 4:
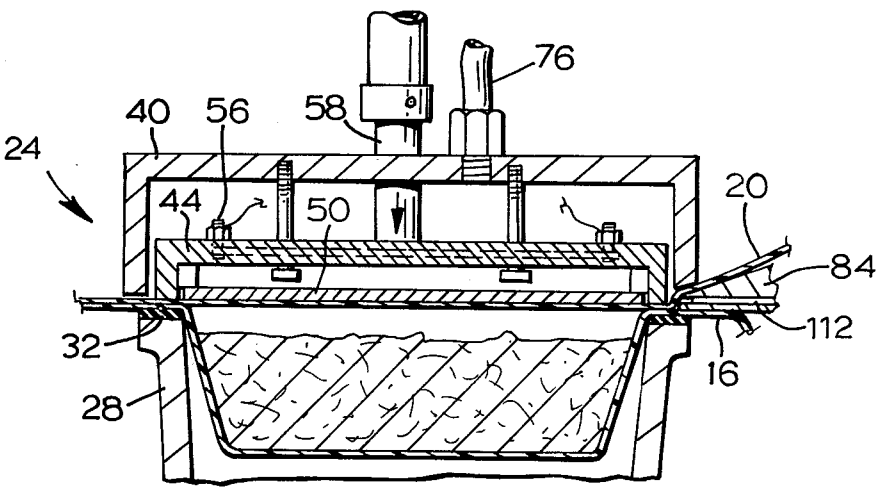

The invention will be more clearly understood after reference to the following detailed specification read in conjunction with the drawings wherein:

FIG. 1 is a pictorial view of the vacuum packaging mechanism of a packaging machine according to an embodiment of the present invention, FIG. 2 is a pictorial view illustrating the structure of the head of the vacuum mechanism of FIG. 1, FIG. 3 is a sectional side view through the mechanism illustrated in FIG. 1 of the drawings, FIG. 4 is a side view similar to FIG. 3 showing the sealing dies in a closed position.

With reference to FIG. 1 of the drawings, the reference numeral 10 refers generally to a first web of heat sealable plastics material of the type commonly used in the manufacture of vacuum packaged articles and in which a plurality of article receiving compartments 12 have been previously formed and loaded with an article 14 which is to be vacuum packaged. A sealing flange 16 extends continuously about the periphery of each compartment 12. The web 10 has wall portions projecting downwardly from the flange 16 which, together with a bottom wall, collectively form a protrusion 18.

A second web 20 of heat sealable plastics material is located in an overlying relationship with respect to the sealing flanges 16 and is heat-sealed to the sealing flanges 16 about the periphery of each compartment 12 in the vacuum packaging process described hereinafter. The support rails 22 serve to support the web 10 in its passage through the vacuum packaging station.

Vacuum packaging machines which incorporate a mechanism for forming the article receiving compartments in the web 10 immediately before the vacuum packaging during operation are well known and may be incorporated into the apparatus of the present invention.

In FIGS. 1, 3 and 4 of the drawings, the reference numeral 24 refers generally to the sealing unit and the reference numeral 26 refers generally to the vacuum unit.

SEALING UNIT

The sealing unit 24 consists of a first sealing die 28 in which a plurality of pockets 30 are formed, each pocket 30 forming a corresponding protrusion 18 in the opposite face of the web. The first die 28 has a resilient gasket 32 extending about the periphery of each pocket 30. The first die housing 28 is mounted on a shaft 34 which is reciprocally driven by a drive unit 36 so that the housing 28 may be moved to and fro between the raised position shown in solid lines and the lowered position shown in broken lines in FIG. 3 of the drawings. In the raised position, the gasket 32 underlies a marginal edge portion of the flange 16 formed about each compartment 12 as shown in FIGS. 3 and 4 of the drawings. It will be noted that the pockets 30 formed in the die 28 are not placed in communication with any source of vacuum.

The second die 24 includes a housing 40 within which a vacuum chamber 42 is formed. A heated sealing plate 44 is located within the vacuum chamber 42 and has a recess 46 formed in the lower face thereof about which a sealing flange 48 extends. The end face of the flange 48 is disposed directly opposite the gasket 32 of the lower sealing die 28. A plate 50 is supported on shoulders 52 and extends across the open end of the recess 46 in a spaced relationship with respect to the sealing flange 48 so that heat is not transmitted from the sealing flanges 48 to the plate 50. Heating elements 54 are embedded in the sealing plate 44 and are connected to a source of electrical energy through terminals 56. Sealing plate 54 is mounted on a pair of shafts 58 which are coupled to shafts 60 of reciprocating drive units 62 which are supported by the frame member 64. (FIG. 1). Shafts 58 extend through passages 66 formed in the upper wall of the housing 40. A collar 68 is located between the shafts 58 and 60 and serves as a stop limiting the downward movement of the shaft 58 with respect to the housing 40. A plurality of guide pins 70 are mounted in the upper wall of the housing 40 and extend downwardly therefrom through guide passages formed in the sealing plate 44 and terminate in heads 72 which serve to limit the downward movement of the sealing plate 44 with respect to the housing 40. A vacuum passage 74 opens through the upper wall of the housing 40 and is coupled to a source of vacuum through a conduit 76. The die unit 24 has an input passage 78 formed at one end thereof and an output passage 80 formed at the other end thereof.

VACUUM UNIT

The vacuum unit consists of a head 84 which is mounted on a pair of arms 82 which are secured at one end to the housing 40 and which project rearwardly therefrom. As shown in FIG. 2 of the drawings, the arms 82 have a threaded passage 86 at the outer end thereof within which a bushing member 88 is threadably mounted. The bushing member 88 having a passage 90 therein. A short stub-shaft 82 projects outwardly from each end of the head 84 to be slidably received within the passage 90 of the bush 88 in a close fitting relationship so that the head 84 may rock about the axis 94. The head 84 has lower face 96 which rests on the sealing flanges 16 of the web 10 in use. The head 84 also has an upper face 98 which is inclined downwardly toward the lower face 96 in a direction toward the sealing die assembly to form a support face for supporting the web 20 in a spaced relationship with respect to the web 10 prior to entry into the sealing station. The head 84 also has a forward end face 100, short triangular shaped wedges 102 project forwardly from the front face 100 and serve as side closures for the vacuum passage which is formed between the webs in use. A chamber 104 is located within the head 84 and a pusher bar 106 is mounted in the chamber 104. The pusher bar 106 is mounted on a shaft 108 of a reciprocating drive unit 110 for movement within the chamber 104 toward and away from the forward end 100 of the head. A plurality of passages 112 extend from the chamber 104 and opens through the forward end face 100 of the head. A plurality of spacer rods 114 have their inner end mounted on the bar 106 and project through selected passages 112. By activating the reciprocating drive mechanism 110, the spacer rods 114 can be moved between the extended position shown in FIGS. 2 and 3 of the drawings and the retracted position shown in FIG. 4 of the drawings. A detector 116 is provided for detecting the location of the bar 106 in the position which it assumes when the rods 114 are fully retracted. The detector 116 is wired to a suitable control circuit which serves to prevent closure of the dies to the heat sealing position until after the spacer rods 114 have been fully withdrawn. The chamber 104 is connected to a source of vacuum through a conduit 118 so that a vacuum may be drawn through the passages 112 which are not restricted spacer rods 114.

METHOD OF OPERATION

In use, an article 14 such as a portion of cheese or meat is loaded into each of the compartments 12 of the lower web 10. Before the webs 10 and 20 are advanced into the sealing station, the housing 28 is located in its lowered position and the housing 40 is located in its raised position and the rods 114 are located in their extended position. Thus, when the webs 10 and 20 are advanced toward the sealing station, they pass over the surfaces 96 and 98 respectively of the head 80 so that when the article storing compartments 12 are located in alignment with the pockets 30 of the housing 28, the spacer rods 114 project into the compartment 12 which is to be evacuated and serve to maintain a spaced relationship between the web 20 and the flange 16 of the web 10 at the input end of the sealing dies. The reciprocating drive unit 36 is activated to raise the housing 28 until the gasket 32 engages the sealing flange 36 extending around the compartments 12 and lifts the sealing flange 16 into engagement with the lower face of the housing 20 about each edge except the edge formed at the input end of the housing 40 where it raises the forward end of the head 80 into wedging engagement with the inclined front face 78 of the housing 40. A vacuum is then drawn in the chamber 104 of the head which in turn draws a vacuum in each of the compartments 12 located within the sealing head through passages 112. The lower web 10, being made from a flexible material, collapses inwardly around each compartment 12 to physically support the article 14 which is located therein. The collapsing of the webs 10 and 20 will be prevented in the area of the input end of the dies by the presence of the spacer rods 114 so that an adequate vacuum can be drawn within each compartment 12. The spacer rods 114 are then withdrawn and the heat sealing plate 44 is lowered to the position shown in FIG. 4 to press the webs 10 and 12 together to form a heat-seal about the peripheral edge of each compartment.

From the aforegoing, it will be apparent that the present invention provides a simple and efficient mechanism for permitting the vacuum packaging of articles while also providing the inward collapsing of the web in which the article supporting compartment is formed so that it supports the article which is located within the package.

What I claim as my invention is:

1. In combination, a sealing unit and a vacuum unit for use in a vacuum packaging machine in which a container spaced formed between oppositely disposed sealing faces have a pair of sealable webs is to be evacuated before the webs are sealed together about the periphery of the container space, said sealing unit comprising;

(a) first and second sealing dies mounted one on either side of a sealing plane for movement relative to one another between an open position to permit movement of a package forming web assembly therebetween and a closed position for engaging and sealing said web assembly, said sealing unit having an input end for receiving web to be sealed between said dies and an output end through which sealed packages are discharged; said vacuum unit comprising;

(b) primary spacer means located adjacent said input end of said sealing dies, said primary spacer means being spaced from said first die to form a first web feeding passage therebetween and spaced from said second die to form a second web feeding passage therebetween whereby said primary spacer means is located between oppositely disposed sealing faces of webs being fed into said dies through said first and second web feeding passages, (c) secondary spacer means located adjacent said input end of said dies and mounted for movement between a retracted position permitting closure of the dies to effect sealing and an extended position maintaining at least a portion of the webs in a spaced relationship to permit evacuation of the container space formed therebetween, (d) means for driving said secondary spacer means to and fro between said retracted and extended positions, (e) vacuum passage means in said vacuum drawing unit opening towards said sealing dies for communicating with the interior of a packaging space when said secondary spacer means is in said extended position to maintain said webs in a spaced relationship whereby atmosphere from the container space may be withdrawn through said vacuum passage means prior to sealing of the webs.

2. A packaging machine as claimed in claim 1 wherein said first sealing die has a chamber formed therein to accommodate the protrusion formed in the first web to form the container space, said chamber being isolated from said vacuum passage means by said first web in use such that the first web is free to collapse inwardly about the product located within said container space as a vacuum is drawn within said container space thereby to physically support the article.

3. A packaging machine as claimed in claim 2 wherein said second sealing die is located in a vacuum chamber whereby the second web may be drawn upwardly into the vacuum chamber to be spaced from the first web during initial feeding of the webs into the chamber.

4. The combination of claim 1 wherein said primary spacer means comprises a spacer head having a first guide face extending in the plane of said first web and a second guide face converging with said first guide face in a direction towards said input end of said dies.

5. The combination as claimed in claim 1 wherein said primary spacer means comprises a head having a forward end disposed at the input end of said sealing dies, said second spacer means comprising finger means mounted in said head and projecting outwardly from the forward end thereof when in said extended position, said means for driving said spacer means being carried by said head, said vacuum passage means extending through said head and opening at said forward end thereof in close proximity to said finger means.

6. The combination as claimed in claim 5 including a chamber formed in said head, a plurality of passages opening from said chamber through said forward end of said head, said finger means comprising a plurality of rods, numbering less than said passages which open from said chamber, each of said rods being slidably mounted in one of said passages and having an outer end projecting outwardly from said front end of said head, the passages which do not house a rod forming said vacuum passages and means for connecting said chamber to a vacuum source, a slide member mounted in said chamber for movement towards and away from said forward end, each of said rods having an inner end mounted on said slide member.

7. The combination as claimed in claim 1 including detector means for detecting the positioning of the secondary spacer means in said retracted position, said detector means being operative to prevent closure of said sealing dies to effect sealing until the secondary spacer means is in said retracted position.

8. The combination as claimed in claim 5 wherein said head is carried by said second die member to be raised and lowered thereby in use.

* * * * *